US007980182B2

(12) United States Patent
Pendley

(10) Patent No.: US 7,980,182 B2
(45) **Date of Patent: *Jul. 19, 2011**

(54) ROOFING RAIL TRANSPORTATION SYSTEM

(75) Inventor: Timothy M. Pendley, Madera, CA (US)

(73) Assignee: Golden Eagle Guilding Products, Inc.

( * ) Notice: Subject to any disclaimer, the term of this patent is extended or adjusted under 35 U.S.C. 154(b) by 0 days.

This patent is subject to a terminal disclaimer.

(21) Appl. No.: 11/476,282

(22) Filed: Jun. 27, 2006

(65) Prior Publication Data

US 2007/0000205 A1 Jan. 4, 2007

Related U.S. Application Data

(63) Continuation of application No. 10/301,271, filed on Nov. 20, 2002, now Pat. No. 7,069,704.

(51) Int. Cl.
*E01B 25/22* (2006.01)
*E04B 1/00* (2006.01)

(52) U.S. Cl. ..... 104/106; 52/745.12

(58) Field of Classification Search ..... 104/106, 104/107, 124–126; 248/278, 283, 284; 52/749.1, 52/745.06, 745.12
See application file for complete search history.

(56) References Cited

U.S. PATENT DOCUMENTS 1,214,094 A 1/1917 Thompson
2,814,533 A * 11/1957 Van Horn ..... 182/14
3,769,916 A 11/1973 Hogan
3,983,676 A 10/1976 Gilpin
4,048,924 A 9/1977 Wibben
4,068,446 A 1/1978 Brueske
4,607,574 A * 8/1986 Richards ..... 104/126
4,695,023 A 9/1987 McCafferty
4,785,606 A 11/1988 Burton
4,828,073 A 5/1989 Friday
5,098,165 A 3/1992 Jacobs et al.
5,105,741 A 4/1992 Leary
5,197,257 A 3/1993 Nietling
5,205,103 A * 4/1993 Burton ..... 52/749.12
5,711,227 A * 1/1998 Johnson ..... 104/126
5,749,434 A 5/1998 Walcher et al.
6,216,416 B1 4/2001 West et al.
7,069,704 B2 * 7/2006 Pendley ..... 52/749.12
2002/0157346 A1 10/2002 Abney
2003/0167730 A1 9/2003 Alderman

OTHER PUBLICATIONS

Filter by CGI Silvercote, Inc. for the Roof Skate Rooftop Sheet-Handling Device (2 pages).

* cited by examiner

*Primary Examiner* — S. Joseph Morano
*Assistant Examiner* — R J McCarry, Jr.
(74) *Attorney, Agent, or Firm* — Mark D. Miller; Marcus N. DiBuduo

(57) ABSTRACT

A rail transportation system particularly suited for transporting roofing materials upon an uncompleted roof. Sections of tubes form rails, allowing several rail cars carrying various roofing materials to transport those roofing materials from the edge of the roof to the point of installation. These tubes may be attached to one another, allowing tradespersons to further extend the range of the rails as the installation progresses.

18 Claims, 4 Drawing Sheets

ROOFING RAIL TRANSPORTATION SYSTEM

This application is a continuation of U.S. patent application Ser. No. 10/301,271 filed on Nov. 20, 2002, now U.S. Pat No. 7,069,704 which is incorporated herein by this reference.

BACKGROUND OF THE INVENTION

1. Field of the Invention

The present invention relates to transportation systems, and more particularly to a device for transporting various roofing materials along the rooftop of a building for installation onto the rooftop.

2. Description of the Prior Art

It is well known that constructing a rooftop requires the placement of several layers of different roofing materials upon the building purlins. These roofing materials consist of one or more layers of insulation material, which are then covered by tile or, on many commercial buildings, sheets of metal roofing. These metal sheets are generally provided in large sections, and are bulky and difficult to manage. The sheets must be lifted onto the rooftop, transported or manually carried across the purlins to their respective destinations, and installed. Furthermore, the tradespersons handling these layers must often work upon the exposed purlins while carrying these materials. Even on non-windy days, this poses significant safety risks to the tradesperson and to those below.

The traditional process for transporting, handling and ultimately installing such materials is time-consuming. Depending upon the material to be installed, this may require the cooperation of several tradespersons to lift and move each sheet. First, several sheets of a particular roofing material are bundled together and hoisted onto the rooftop. Tradespersons on the roof must then unbundle each sheet, carry it across the exposed purlins to its destination, and install it. They must then return to the bundle to repeat the process. This task is further complicated by the fact that the distance from the bundle to the placement location increases as the work progresses, requiring more time and effort to transport each individual sheet to its ultimate destination. The work continues until the final sheet of material is installed at the opposite end of the rooftop.

A variety of devices have been developed to transport these materials upon the rooftops, many of which involve transportation devices movably mounted upon the purlins. For example, U.S. Pat. No. 4,068,446 discloses a movable platform that travels along the purlins by internal means of locomotion. This platform is large enough to support several tradespersons, and allow them to work from atop the platform. A fence surrounds the platform to prevent the tradespersons from falling. Outrigger arms, a winch assembly, and an insulation roller system increase the functionality of this device. Furthermore, the device may travel from the purlin onto a completed roof panel via rails placed onto the panel.

U.S. Pat. No. 6,216,416 discloses a dual sectional working platform, also traveling upon the purlins. One section serves as the materials handling area, where various roofing materials are installed onto the purlins. The other section serves as a support platform for the tradespersons while they install the materials. A series of rollers along one side of the platform allow tradespersons to move roofing materials from one end of the platform to the other. The platform itself is moved via a winch connecting the platform to the far end of the roof; this winch is manually turned to move the platform.

U.S. Pat. No. 5,749,434 discloses a device for transporting roofing materials specifically along pitched rooftops. The device consists of various roller assemblies movably mounted onto the purlins, with pipes connecting the assemblies to form a single platform. The roofing materials are placed onto the platform, and held in place by stop pieces installed at the ends of the platform. This device is then dragged behind the tradespersons as they install the roofing materials.

Unfortunately, none of the above described devices are particularly suited for simple and lightweight travel upon sections of completed rooftops. Most of the above described inventions are designed to travel solely upon the building purlins. Thus, their movements and directions are limited by the particular placement of the purlins, and further limited to those sections of the rooftop where the purlins remain exposed. The '446 invention does provide one particular method claim which allows that invention to move onto a section of completed rooftop. However, any such extended movement is generally impractical given the size and weight of the invention, since prolonged use of the invention in such a manner risks damage to the rooftop from the sheer weight and bulk of the invention.

This reveals another inherent problem with many of the above described inventions, namely that they are generally large and heavy. Most of them contain locomotive means, and various other features that assist in the actual placement and installation of the roofing materials. Those inventions must furthermore be sturdy and large enough to support the weight and movement of several tradespersons upon the devices themselves, in addition to the weight of the roofing materials. Such features are beneficial, but they also increase the size and weight of the inventions. They also increase the costs of purchasing and deploying the devices, as well as maintaining them over time. A final drawback is that those inventions are not readily expandable; they are limited to carrying only certain dimensions of roofing material, and may not be sufficiently large to carry certain other materials.

It is therefore desirable to provide a lightweight and expandable device for use in transporting various roofing materials upon sections of completed roofing, such that they may then be installed onto their proper locations.

SUMMARY OF THE INVENTION

The present invention provides a simple, relatively lightweight and expandable device for use in transporting roofing materials upon sections of completed roofing. The tool of the present invention is in the form of several portable rail carriages or cars and various elongated sectional tubes. The rail cars have a generally flat top surface, allowing them to hold the various roofing materials, with slight upward curvatures at the surface ends to prevent the materials from sliding off the cars. Each rail car also contains four wheels, two located at each end of the car, having edges that are generally concavely shaped.

Pairs of tubes constitute the other part of this invention. The first end of each tube is generally smaller in diameter than the remainder of the tube. The second end contains a hollow cavity. The tubes are cylindrical, with a convex surface curvature that corresponds to the concave curvature of the edges of the rail car wheels. This permits each rail car to rest securely upon, and travel smoothly along, the tubes. Two tubes are deployed in a parallel manner to form a single pair of rails. A brace is inserted between the tubes to ensure that they maintain their parallel relationship. The rails may be extended by adding additional tubes, specifically by inserting the first end of a tube into the hollow cavity of the second end of another tube.

In use, the rails are laid parallel upon the installed roofing materials. Rail cars are then placed upon the rails. Two or more rail cars, each traveling upon separate parallel pairs of rails, provide a platform upon which various roofing materials, such as insulation or sheets of metal roofing, may be placed. The size of the platform may be modified to accommodate different dimensions of roofing materials by adding or removing rail cars, or by adding additional parallel pairs of rails and corresponding cars. A tradesperson then moves the platform (the rail cars) along the rails to transport the roofing materials from the unloading area to the ultimate place of installation.

Accordingly, the present invention provides the tradesperson with a simple, relatively lightweight and expandable device for use in transporting various roofing materials across sections of completed roofing. The rails allow the invention to travel anywhere upon the completed roofing, so that the invention is not limited solely to any particular area of exposed purlins. Unlike most of the previous inventions disclosed above, the rail cars are individually portable and relatively lightweight, since they are designed only to hold the roofing materials. They are also inexpensive, and easily disassembled and stored upon the completion of a project.

It is therefore a primary object of the present invention to provide a transportation system that is capable of traveling upon previously installed roofing materials via a system of extendable rails that are temporarily installed during roof construction across completed sections of the roof.

It is also a primary object of the present invention to provide a transportation system having an expandable platform upon which different dimensions of roofing materials may be transported, simply by adding or removing the number of rails and cars that together constitute the roofing materials platform.

It is also an important object of the present invention to provide a transportation system that is relatively small, lightweight and portable, so as to minimize any weight stress upon the roofing materials, and at the same time, to facilitate the usage and transportation of the device.

It is also an important object of the present invention to provide a transportation system that is inexpensive to purchase, deploy and maintain, such that greater numbers of tradespersons may readily utilize the invention.

It is also an important object of the present invention to ensure the safety of tradespersons installing roofing materials upon rooftops, by freeing them of the burdens and dangers that arise from manually transporting various bulky roofing materials from any one place on the rooftop to another place.

Additional objects of the invention will be apparent from the detailed description and the claims herein.

DETAILED DESCRIPTION OF A PREFERRED EMBODIMENT

Figure 7:
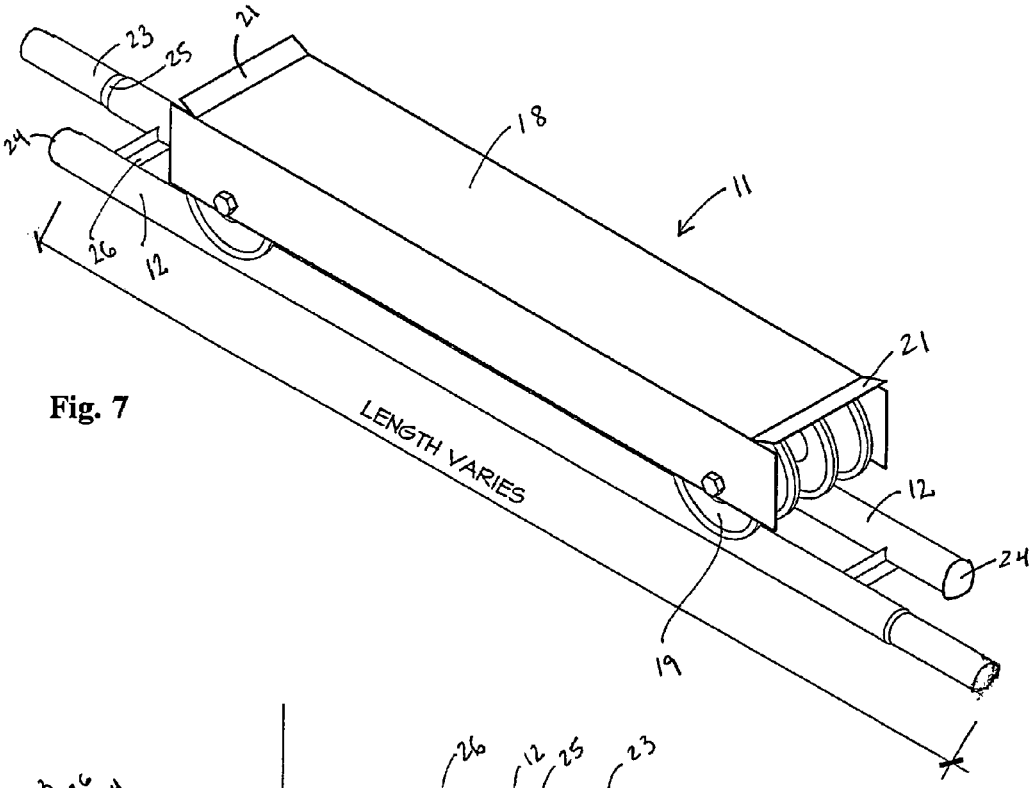
FIG. 7 is a side perspective view of one of the cars of the present invention, resting upon a pair of tubular rails.
Figure 8:
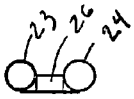
FIG. 8 is an end elevation view of a pair of rails of the present invention.
Figure 9:
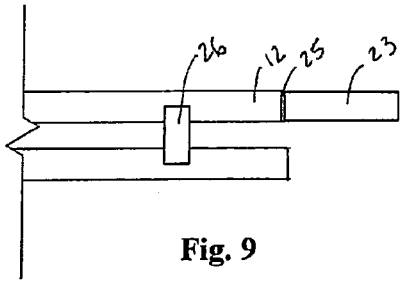
FIG. 9 is a bottom plan view of a pair of rails of the invention.

Referring to the drawings wherein like reference characters refer to the same or corresponding structures throughout the several views, and referring specifically to FIG. 7, it is seen that the invention includes one or more cars or carriages, generally denoted by the numeral 11, resting upon and traveling along a pair of tubular rails, generally denoted by the numeral 12.

Figure 1:
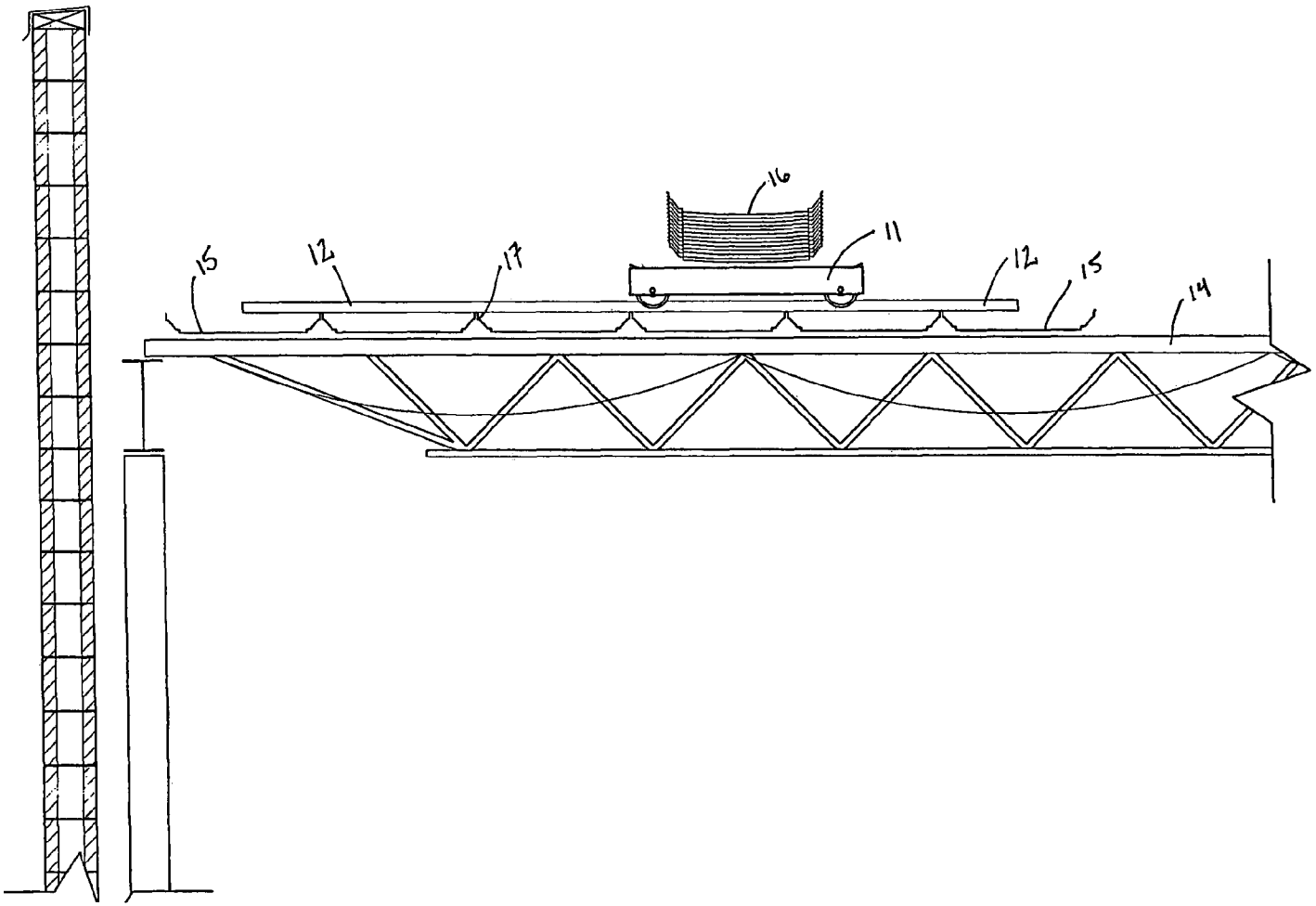
FIG. 1 is an environmental side view of rail system of the present invention supporting various roofing materials deployed upon the partially constructed roof of a building.

FIG. 1 illustrates the invention within the environment of a partially completed rooftop. Here, the insulation material has already been installed across the purlins 14. Various sheets of metal roofing 15 have also been installed upon the purlins 14, although that process has not yet been completed. Several uninstalled sheets of metal roofing 16 remain upon the car 11. The car rests upon, and travels along, the tubular rails 12 that generally extend to the edge of the installed metal roofing 15. This allows the rail car to travel almost to the edge of the installed metal roofing, decreasing the distance that a tradesperson must carry the uninstalled metal roofing 16 before installing it in its proper location. While the diagram shows the rails 12 lying across the ribs 17 where the different sheets of metal roofing overlap, it is to be appreciated that the rails may be placed in any direction relative to the ribs 17, or alternatively, that they may be placed in any direction upon the insulation material itself.

Figure 2:
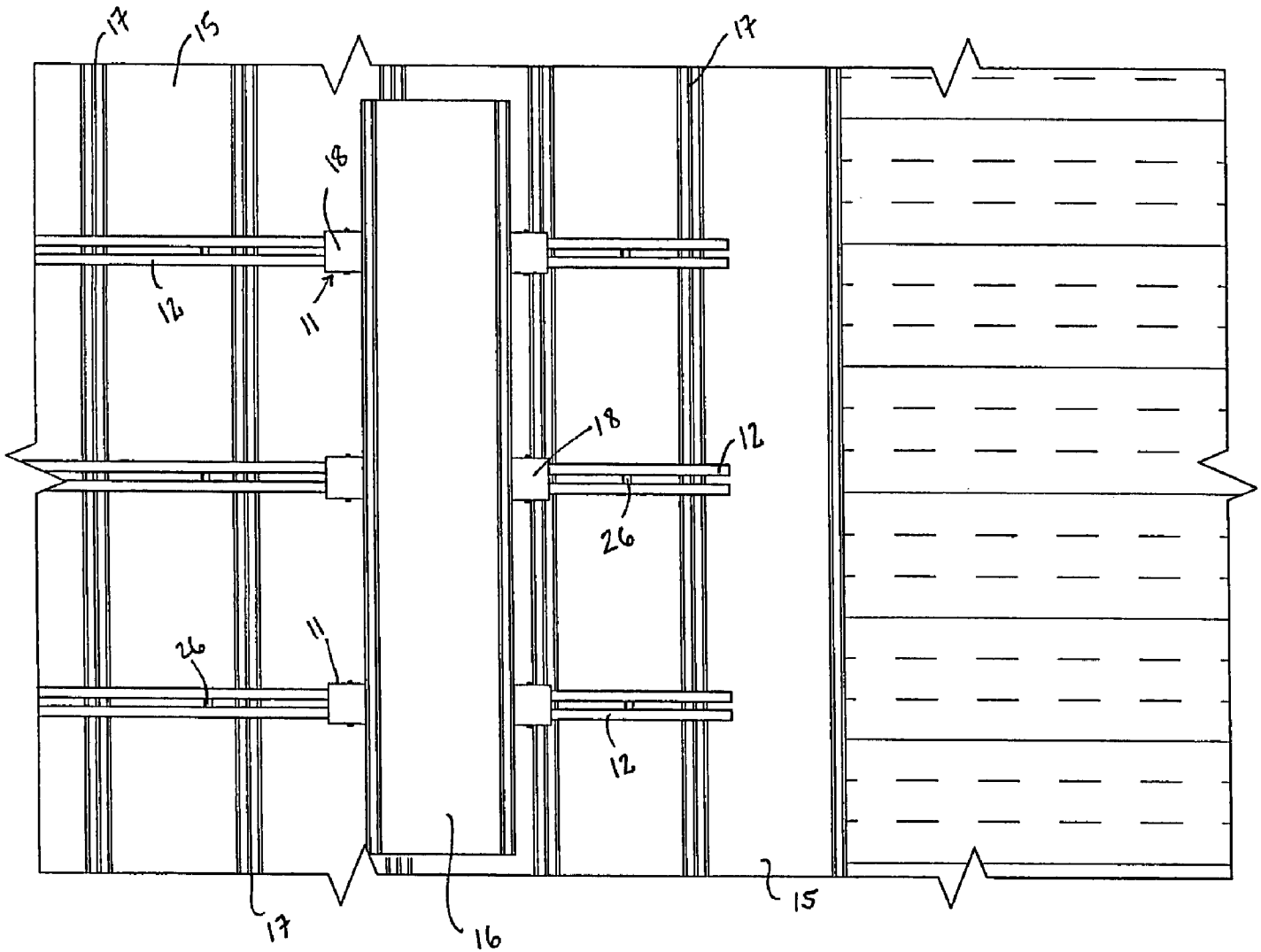
FIG. 2 is a top view of the invention in the environment of FIG. 1.

FIG. 2 provides a top perspective of the same environment as FIG. 1. By way of example and for illustrative purposes only, and without limiting the appended claims, this diagram reveals numerous rail cars 11 that collectively form a single platform upon which the uninstalled sheets of metal roofing 16 are placed. FIG. 2 also reveals the various pairs of rails 12, laid in a parallel manner, one pair per rail car, which the cars rest upon and travel along. It is apparent that cars 11, and corresponding pairs of rails 12, may be added or removed to accommodate the particular dimensions of various roofing materials.

Figure 3:
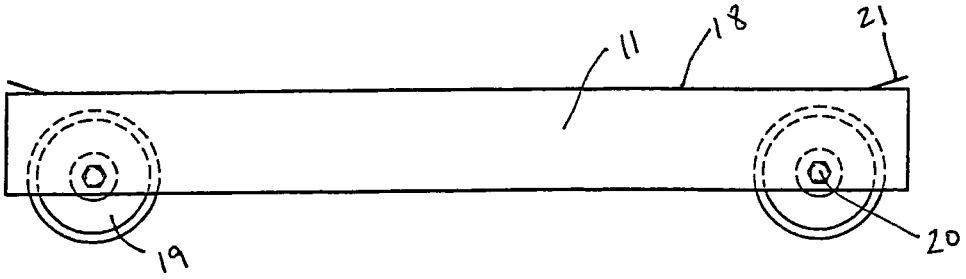
FIG. 3 is a side elevation view of one of the cars of the present invention.

FIG. 3 illustrates a typical car or carriage 11 of the present invention. This car 11 is representative of, and contains the same features and characteristics as, all the other cars of the invention. The upper surface 18 of the rail car 11 is generally flat, and may include a slightly upward curvature 21 at each end. This curvature prevents any roofing materials from falling off the car 11 as it travels along rails 12. Car 11 includes wheels 19 that are adapted to move along the tubular rails 12; specifically, the outer annular edges of wheels 19 are concavely shaped such that they fit the surface curvature of the rails 12 upon which they travel. The wheels 19 are attached to the rail car 11 and held in place by a nuts and axel mechanism 20.

Figure 4:
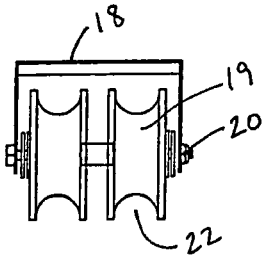
FIG. 4 is a front elevation view of one of the cars of the invention.
Figure 5:
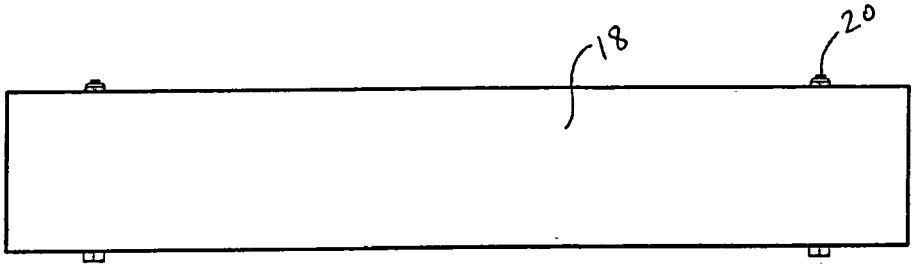
FIG. 5 is a top plan view of one of the cars of the present invention.
Figure 6:
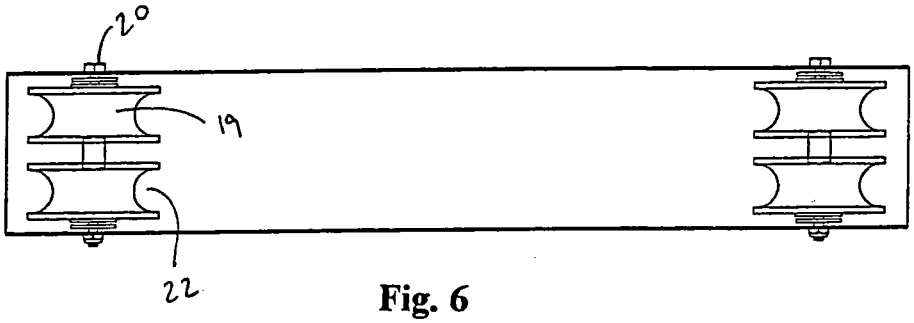
FIG. 6 is a bottom plan view of one of the cars of the invention.

FIG. 4 provides another perspective of a rail car or carriage 11. This diagram reveals that each end of the rail car 11 contains two wheels 19, one wheel per rail. It further reveals the concave curvature 22 of each wheel 19. This curvature corresponds to the convex curvature of the tubular rails 12, such that the wheels rest securely upon, and travel smoothly along, the rails. The diagram also illustrates the close proximity of the wheels 19 to each other. This gives the rail car 11 a narrow width, making it easier for a single tradesperson to carry and deploy the invention.

FIG. 7 shows both a rail car 11 and rails 12 of the invention. In particular, it illustrates that each wheel 19 of a rail car rests securely upon the rails 12, based upon the above described curvature relationship, such that the rail car 11 may travel smoothly and securely along the rails 12. The diagram further shows the two sectional elongated cylindrical tubes that form the rails 12. These tubes are representative of, and contain the same features and characteristics as, all the other tubes of the invention. The first end 23 of each tube is slightly smaller in diameter than the remainder of the tube. This allows the tradesperson to insert the first end 23 of the tube into the hollow cavity 24 at the second end of another tube, until the annular shoulder 25 rests securely against the second end of the other tube. This permits the tradesperson to extend the rails as necessary, allowing the rail car 11 to travel the entire length of the rooftop. Braces 26 are placed between the pairs of tubes at different intervals, maintaining the position of the tubes as parallel to one another. Braces 26 ensure that the pairs of rails 12 are consistently spaced apart from each other along their entire length, so that cars 11 rest securely upon, and travel smoothing along, the rails 12, regardless of their location along the length of the rails.

Figure 10:
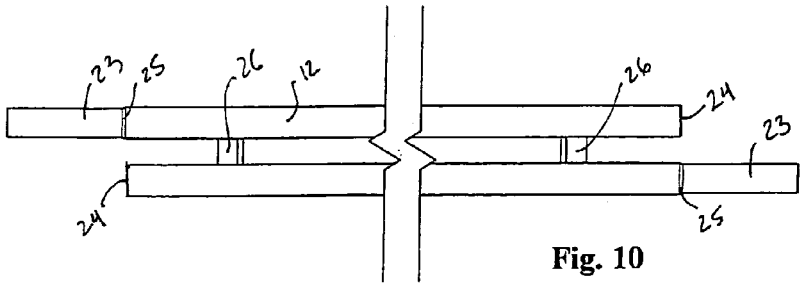
FIG. 10 is a top plan view of a pair of rails of the invention.

FIG. 10 illustrates the tubular rails 12 of the invention. In the preferred embodiment, the tubes are of equal length, although tubes different lengths may be employed in a staggered relationship for added stability and to avoid separation. The tubes face in opposite directions and are offset slightly, such that in the preferred embodiment, the hollow cavity 24 of the first tube of the pair is adjacent to the annular shoulder 25 of the second tube, and vice versa. This particular formation allows the rails to distribute the stress placed upon them, so that the rails do not support the entire weight of the rail cars and their cargo upon any two adjacent points in the rails. This decreases the likelihood that the rails will break under the combined weight above them.

In use, the uninstalled roofing materials are bundled and hoisted onto the roof area. Tradespersons upon the roof install a single row of roofing material, and place a pair of rails upon the installed roofing material for each rail car. At least two pairs of rails and two corresponding rail cars are generally required. However, the number of rail pairs and corresponding rail cars needed depend upon the dimensions of the roofing materials to be carried. The rail cars are then placed upon the rails to form a platform, and the roofing materials placed onto the platform. The rail cars are then rolled along the rails to the edge of the installed roofing materials. The tradespersons then offload sheets of roofing materials from the platform for installation. As each sheet of roofing material is installed, the tradespersons attach additional tubes to the rails, thereby extending the rails and permitting the platform to be moved to the edge of the installed roof. This places the roofing materials within easy reach of the tradespersons, and saves them the time and effort of manually carrying the roofing material from the original location to the place of installation. This process continues until the last row of roofing material is installed. The tradespersons then remove the cars, disassemble the rails and carry the entire device down to the ground.

It is to be understood that variations and modifications of the present invention may be made without departing from the scope thereof. It is also to be understood that the present invention is not to be limited by the specific embodiments disclosed herein, but only in accordance with the appended claims when read in light of the foregoing specification.

What is claimed is:

1. A method for transporting roof installation materials during installation of a section of a roof of a building comprising the following steps:

(a) completing a section of roof, wherein said section of roof is generally horizontal;

(b) temporarily placing at least two sets of generally parallel elongated tubes onto said completed roof section, wherein each set extends a distance on the completed roof section, wherein each tube has a convex outside surface curvature, wherein each set is generally parallel to each other;

(c) placing a movable platform on each set of tubes, each platform having a flat upper surface, a front and a rear, at least two wheels underneath the front and at least two wheels underneath the rear, the exterior surfaces of all of said wheels having a concave curvature corresponding to the convex exterior curvature of said tubes for rotatable movement along said tubes, wherein no support for said tubes extends above said upper surface of said platforms;

(d) depositing elongate roofing material onto said platforms such that said elongate material extends between and is simultaneously supported by all of said platforms;

(e) moving said platforms supporting said elongate material in a generally simultaneous manner along the sets of tubes to transport said elongate material to a distal end of the sets; and (f) installing the elongate material to create a new section of roof.

2. The method of claim 1 wherein said tubes rest upon a plurality of ribs extending upward from completed sections of roof, and said tubes extend from the edge of the building to the edge of the most recently completed section of roof.

3. The method of claim 1 comprising the additional steps of:

(g) attaching additional tubes to extend the parallel sets over the newly created section of roof; and (h) repeating steps (d) through (f) to create another new section of roof.

4. A method for installing a new section of roof comprising the steps of:

(a) completing a first section of generally flat roof;

(b) temporarily placing at least two sets of elongated tubes onto said first section of roof in a generally parallel orientation, such that said tubes extend a distance on said first section of roof between edges thereof, each tube having a convex outside surface curvature;

(c) placing a movable platform on each set of tubes, wherein each platform comprises a flat upper surface, a front and a rear, at least two wheels underneath the front, and at least two wheels underneath the rear, the exterior surfaces of all of said wheels having a concave curvature corresponding to the convex exterior curvature of said tubes for rotatable movement along said tubes;

(d) depositing elongate roofing material onto said platforms such that said elongate material is simultaneously supported by and extends between all of said platforms;

(e) moving said platforms carrying said elongate material along said sets of tubes at about the same time; and (f) installing said elongate material at an edge of said first section of roof to create a new section of roof.

5. The method of claim 4 comprising the additional steps of:

(g) attaching tube extensions to extend said tubes over the new section of roof in a generally parallel orientation; and (h) repeating steps (d) through (f) to create another new section of roof.

6. A method of installing sections of roof comprising the steps of:

a. temporarily placing at least two sets of tubes on an existing section of a partially completed roof in a generally parallel orientation such that set extends from approximately a proximal edge of said roof to approximately a distal edge thereof, each tube having a convex outside surface curvature;

b. placing a cart on each set of tubes near said proximal edge, each of said carts having a top surface and wheels underneath, the exterior surfaces of said wheels having a concave curvature corresponding to the convex exterior curvature of said tubes, wherein no support for said tubes extends above said top surfaces of said platforms;

c. placing an elongate section of roofing material on said carts such that said material extends between and has a weight simultaneously borne by at least two of said carts;

d. moving said carts bearing said elongate section of roofing material along said sets of tubes in a generally simultaneous manner to near said distal edge of said partially completed roof; and e. installing said elongate section of roofing material at said distal edge, thereby establishing a new distal edge of said roof.

7. The method of claim 6 comprising the additional steps of:

f. attaching additional tubes to extend the sets of tubes in generally parallel orientations over the new roof section to approximately the new distal edge thereof, wherein no support for said additional tubes extends above said top surfaces of said platforms;

g. moving said carts back to near said proximal edge;

h. placing an additional elongate section of roofing material on said carts such that said material extends between and has a weight simultaneously borne by at least two of said carts;

i. moving said carts bearing said elongate section of roofing material along said sets of tubes in a generally simultaneous manner to near said new distal edge of said roof; and j. installing said elongate section of roofing material at said new distal edge, thereby establishing a newer distal edge for said roof.

8. The method of claim 7 comprising the additional steps of repeating steps (f)-(j) of claim 7 as to the newest installed section of roof.

9. A method of installing sections of roof comprising the steps of:

a. installing a first elongate section of roof along an edge of a generally flat top of a building;

b. temporarily placing at least two sets of tubes on said first section of roof in a generally parallel orientation such that said sets extend from approximately a proximal edge of said roof to approximately a distal edge thereof, each tube having a convex outside surface curvature;

c. placing a cart on each of said sets of tubes near said proximal edge, each such cart having front and back pairs of wheels underneath, wherein each of said wheels have a concave exterior curvature corresponding to the convex exterior curvature of said tubes and are adapted to rotate along said tubes;

d. placing a second elongate section of roof on said carts such that said second elongate section of roof extends between and has a weight borne simultaneously by at least two of said carts;

e. moving said carts bearing said second elongate section of roof along said sets of tubes in a generally simultaneous manner to near said distal edge of said roof; and f. installing said second elongate section of roof at said distal edge, thereby establishing a new distal edge of said roof.

10. The method of claim 9 comprising the additional steps of:

g. extending said tubes in generally parallel orientations over the new roof section to approximately the new distal edge thereof;

h. moving said carts back to near said proximal edge;

i. placing a third elongate section of roof on said carts such that said third elongate section extends between and has a weight borne simultaneously by at least two of said carts;

j. moving said carts bearing said third elongate section of roof along said sets of tubes in a generally simultaneous manner to near the new distal edge of said roof; and k. installing said third elongate section of roof at said new distal edge, thereby establishing a newer distal edge of said roof.

11. The method of claim 10 comprising the additional steps of repeating steps (g)-(k) of claim 10 for additional elongate sections of roof.

12. A method for constructing a roof on building purlins comprising the steps of:

a. installing a first elongate section of roof on said purlins to form a partial roof;

b. temporarily placing two generally parallel sets of tubes on said first section of roof, said sets being separated by a first distance and each of said sets comprising two parallel elongate rounded tubes;

c. placing a moveable platform having a top surface, at least two front wheels, and at least two rear wheels on each of said sets of tubes, wherein each of said wheels has a concave curvature corresponding to said tubes for rotatable movement thereon, and wherein no support for said tubes extends above said top surface of said platform;

d. placing a second elongate section of roof on said platforms such that said second section of roof has a first end supported by a first platform and a second end simultaneously supported by a second platform, wherein a length of said second elongate section of roof is greater than said first distance;

e. simultaneously moving each of said platforms along with said second section of roof from a first position on said partial roof to a second position on said partial roof; and f installing said second section of roof on said building purlins adjacent to said first section of roof.

13. The method of claim 12, further comprising the step of repeating steps (d)-(f) for additional sections of roof.

14. A device for transporting elongate roofing material across a roof, comprising:

a. a plurality of platforms each having a flat top surface and a plurality of wheels, wherein each of said wheels has an outside concave curvature surface;

b. a plurality of elongated hollow sectional tubes for temporary deployment along said roof to rotatably engage said wheels of said platforms, each tube having a leading end and a trailing end and an outside convex curvature surface corresponding to said outside concave curvature surface of said wheels, said tubes deployed in at least two tracks, each track comprising at least two tubes, wherein said tracks are separated by a length about equal to a length of said elongate roofing material, and wherein no support for said tubes extends above said top surfaces of said platform; and c. at least one spacer for insertion between the tubes of each of said tracks such that said tubes are held in equidistant positions throughout the entire length of said tracks.

15. The device of claim 14, wherein the top surface of said platform is generally flat and upwardly angled sections are provided at the front and back ends of said platform to prevent said roofing material from sliding off from the front and back ends.

16. The device of claim 14, further comprising extensions attached to said tracks in the form of additional elongated hollow sectional tubes.

17. The device of claim 14, wherein said roof comprises purlins and at least one elongate roofing material installed on said purlins, and wherein said tracks are supported by said installed elongate roofing material.

18. The device of claim 14, wherein said platforms are movably deployed on said tracks, and additional elongate roofing material is placed upon, extends between and is simultaneously supported by at least two of said platforms.

* * * * *